United States Patent [19]

Cannon

[11] 4,289,941

[45] Sep. 15, 1981

[54] LOAD BREAK SWITCH ARC SUPPRESSION

[75] Inventor: John W. Cannon, Roanoke, Va.

[73] Assignee: General Electric Company, New York, N.Y.

[21] Appl. No.: 970,430

[22] Filed: Dec. 18, 1978

[51] Int. Cl.[3] ..... H01H 33/12; H01H 9/38

[52] U.S. Cl. ..... 200/146 R; 200/62

[58] Field of Search ..... 200/146 R, 62 R

[56] References Cited

U.S. PATENT DOCUMENTS

| | | | |
|---|---|---|---|
| 2,226,385 | 12/1940 | Ramsey | 200/62 |
| 2,308,026 | 1/1943 | Rawlins | 200/62 |
| 2,337,889 | 12/1943 | Harlow et al. | 200/146 R |
| 2,840,671 | 6/1958 | Gieffers | 200/146 R |
| 3,243,538 | 3/1966 | Rodeseike | 200/146 R |
| 3,549,840 | 12/1970 | Harner | 200/146 R |
| 3,681,548 | 8/1972 | Erickson | 200/146 R |

*Primary Examiner*—Robert S. Macon
*Attorney, Agent, or Firm*—Walter C. Bernkopf

[57] ABSTRACT

The invention relates to an improved load break switch having auxiliary contact members for making contact while the main contact members separate. When the moveable auxiliary contact member, i.e. flipper blade, opens, an arc is drawn causing deformation of the auxiliary stationary contact member. This can prevent proper operation, e.g. latching of the moveable contact member. Arc supporting means, connected in a low impedance circuit to the stationary contact are secured adjacent to the stationary member and intermediate the latter and the open position of the moveable member along the opening path of the latter. The arc is thus rapidly transferred from the stationary contact to minimize contact deformation.

16 Claims, 9 Drawing Figures

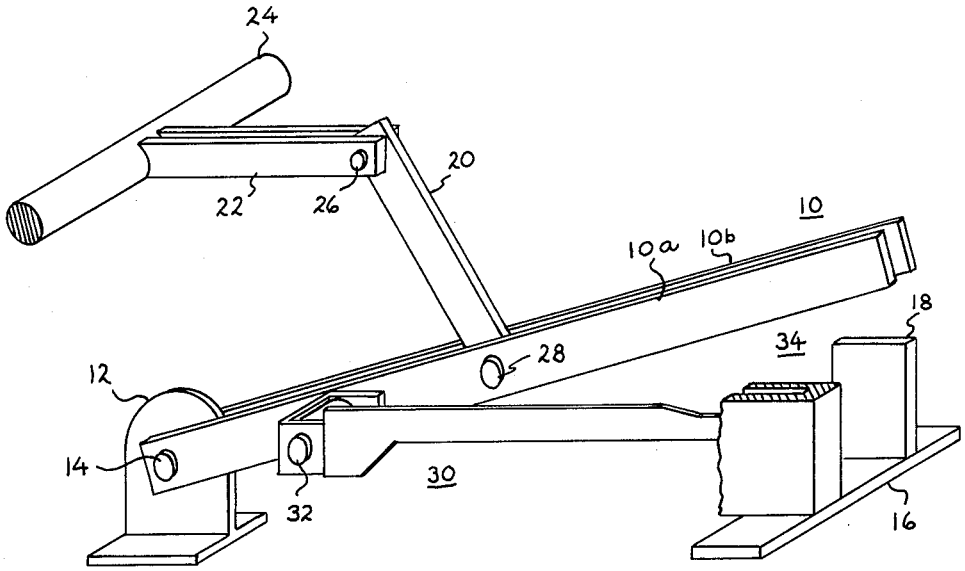
PRIOR ART
FIG. 1
FIG. 8
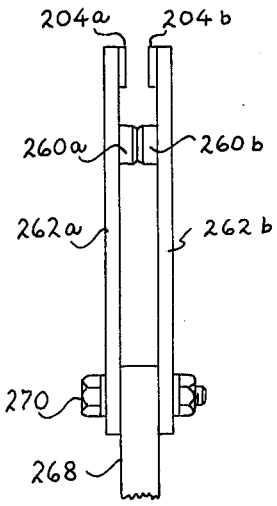
FIG. 9
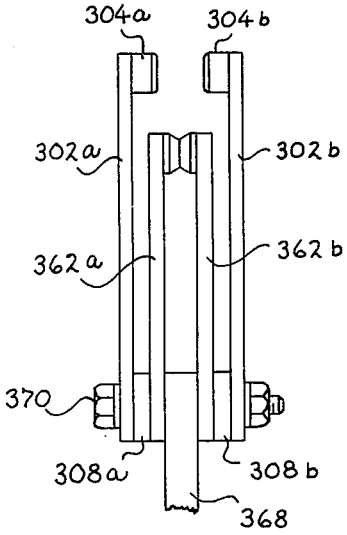

LOAD BREAK SWITCH ARC SUPPRESSION

BACKGROUND OF THE INVENTION

The invention relates to an improved electrical switching system and particularly to an improved load break switch.

Electric loads drawing high alternating current from a source of high voltage are commonly connected to the source through load break switches, also termed interrupter switches. These switches are specially designed to interrupt the high load and magnetizing currents when the load is interrupted. Load break switches commonly include a main, blade like, moveable contact member adapted to rapidly close and make contact with a main stationary contact member and to rapidly open so as to break this contact. Load interruption at high voltage and high currents is subject to substantial and potentially dangerous and destructive arcing, including sustained arcing from phase to phase. One common arrangement for preventing these deleterious effects is to add auxiliary contact members to the switch. The auxiliary members briefly continue to make electrical connection across the switch while the main contact members commence opening. Thus, the main contact members do not open under power and arcing between the main contact members is prevented.

The auxiliary members generally include a movable contact member, e.g. a flipper blade, pivotally coupled to the main moveable contact member, and an auxiliary stationary contact member that is electrically connected to the main stationary contact member. When the switch is opened the main, contact members break contact while the auxiliary contact members briefly continue to make contact. Thereafter the auxiliary contacts rapidly break contact. Disengagement of the auxiliary moveable contact member, e.g. the flipper blade, from the auxiliary stationary contact member mechanically draws an arc in an arc chute. The hot arc is blown away from the rapidly moving flipper blade and cooled by contact with the large area of the chute sides and the auxiliary moveable member opens to produce a sufficient air gap to isolate the terminals of the switch.

The auxiliary stationary member frequently comprises a pair of contact members that are spring biased to abut each other. When the breaker switch is closed, the flipper blade is moved from its open position with sufficient force to stab through the abutting pair of contact members. When the switch is opened the auxiliary moveable member, e.g. the flipper blade, is briefly restrained by this pair of contact members while the main contact members break contact. The flipper blade thereafter breaks through the pair of contact members and moves to its open position.

Reliable stabbing action upon switch closure is thus required to assure that the main contact members do not open under power when the switch is opened. Many designs also rely on proper stabbing action to assure that the auxiliary moveable contact member, e.g. flipper blade, opens at a sufficiently high velocity. This rapidly extinguishes the arc when the switch is opened and thus reduces arc chute erosion. The high velocity opening results from a spring that is precharged during the brief interval when the blade is restrained. In many designs proper stabbing action is required to assure that the spring is properly precharged.

The auxiliary stationary means, therefore, have a carefully designed contact contour to insure proper stabbing. The lead in of the stationary contact members is designed to assure that the moveable member, e.g. flipper blade, properly stabs into the contact members whenever the switch is closed.

However, when the auxiliary contact members separate upon switch opening, an arc is generated in the area of the lead in contour of the stationary contact members. The severity of the arc is related to the amplitude of load current. It is particularly severe at maximum rated current. This arcing causes some erosion, e.g. pitting, of the auxiliary stationary contact members. The resulting contact erosion accumulates with repetitive use, i.e. make-break cycling, of the switch. With repeated cycling this erosion could prevent proper interfacing, e.g. stabbing, between the moveable and stationary auxiliary contact members.

OBJECTS OF THE INVENTION

A primary object of the present invention is to provide an improved load break switch.

Another object is an improved arrangement for minimizing arc erosion of the contact members of a load break switch.

A further object is an arrangement for preventing the arc erosion of auxiliary contact members provided to prevent opening of the main contact members under power.

Other objects of this invention together with ways and means of attaining the various objects will be apparent from the following description and accompanying illustrations thereof.

BRIEF DESCRIPTION OF THE DRAWINGS

FIG. 1 is a perspective view of a simplified version of a conventional type of load break switch;

FIG. 8 is a side elevation view of an alternative embodiment of the auxiliary stationary member and arc supporting means; and FIG. 9 is a side elevation view of another alternative embodiment of the auxiliary stationary member and arc supporting means.

SUMMARY OF THE INVENTION

Figure 2:
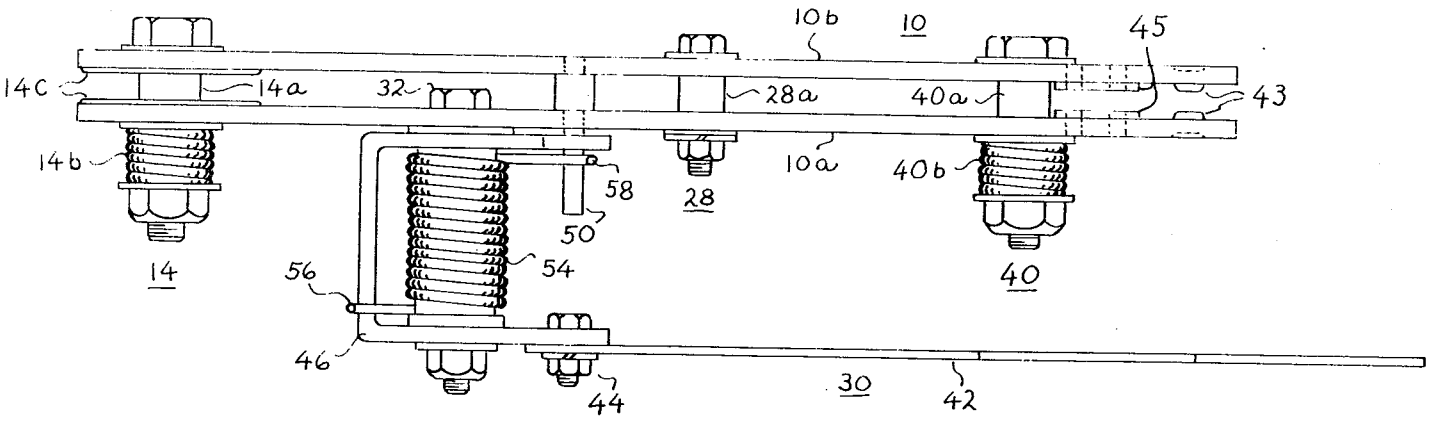
FIG. 2 is a plan view of moveable main and auxiliary contact members of such a load break switch.

In general the objects of the invention are accomplished in a load breaker switch of the type comprising an auxiliary moveable contact member adapted to disengage from auxiliary stationary means upon disengagement of main contact members and to move to an open position. Means are generally provided for preventing premature disengagement of the auxiliary means. At least one arc supporting means is positioned intermediate the stationary member and the open position, but displaced from the path of motion of the moveable member, to provide for rapid transfer of arc attachment from the auxiliary stationary contact member upon disengagement of the moveable member. The moveable contact member may comprise a pivotally mounted blade and the stationary member may comprise a pair of contact members that are supported by planar spring members arranged on opposing sides of the plane of pivotal motion of the moveable member. The preferred embodiment utilizes arc supporting means comprising a first member secured at one end to the conducting base member, which also supports the planar spring members, and a second member extending orthogonally to the first member. These arc supporting members are disposed intermediate the stationary contact member and the open position of the moveable contact member such that the arc is rapidly transferred from the stationary contact member to the arc supporting member. Alternative embodiments include, for example, attaching the arc supporting means to one or both of the planar members supporting the stationary contact members.

DESCRIPTION OF A PREFERRED EMBODIMENT

FIG. 1 is a simplified representation of a known type of load break switch. The switch selectively makes or breaks contact between base terminals 12 and 16. A main moveable contact member 10 comprising parallel blades 10*a* and 10*b* is pivotally mounted at one end to base terminal 12 by bushing 14. The opposite ends of blades 10*a* and 10*b* are adapted to engage main stationary contact 18 which is secured to and electrically connected to base terminal 16. The main contact member 10 is pivoted by a rod and crank arrangement so as to open and close the main contact members. This arrangement comprises a rotatable crankshaft 24 having a rigidly connected crank arm 22 that is pivotally, connected by pin 26, to one end of operating rod 20. The other end of operating rod 20 is pivotally connected, by pin 28, to the main contact blades 10*a* and 10*b* intermediate their ends.

The auxiliary moveable contact member 30 is pivotally mounted, by member 32, to the main blade assembly. The switch is closed by imparting clockwise rotation to shaft 24. The resulting motion of crank 22 and rod 20 rapidly pivots the main moveable contact 30 clockwise to quickly engage stationary contact 18. Load break switch assemblies generally utilize a plurality of switches of the type illustrated in FIG. 1 arranged in a parallel configuration in a housing and actuated by a common shaft. One switch is utilized for each electrical line. Thus a three phase system utilizes three switches. The shaft rotation may be actuated by a stored energy mechanism (which is not illustrated) comprising a spring which is charged manually by an operating handle or by an electric motor so as to provide for snap action motion of the shaft. For example, an operating handle is coupled to a compression spring. Rotation of the handle from its open to its closed position causes the overcenter spring to compress and go over the toggle position. The spring is coupled, e.g. via a drive crank, to crank shaft 24, such that the shaft snaps through a few degrees of rotation, and the main moveable contact member 10 snaps to engage the main stationary contact member 18. The mechanism 1perates in a similar manner to open the switch and thus provides for both rapid make and break operation.

During switch closure, the main moveable contact member rapidly pivots from its open to its closed position. As described subsequently, the auxiliary moveable contact member 30 moves in parallel with the main moveable contact member to engage the auxiliary stationary contact member, which is located within the assembly schematically identified as 34 in FIG. 1. The main and auxiliary members are designed so that the main members make contact prior to engagement of the auxiliary contact members. When the switch is opened, the mechanism comprising members 20, 22 and 24, pivots main moveable contact member 10 to its open position. As shown in FIG. 1, the auxiliary moveable contact member 30 briefly remains in its closed position so as to make contact with the auxiliary stationary contact member. After the main contact members have broken contact and have separated by a substantial distance, the auxiliary moveable contact member 30 rapidly disengages from the auxiliary stationary contact member. Member 30 then quickly flips to an open position. Member 30 thus rapidly draws out the arc generated when the auxiliary members break contact. An arc chute is arranged about the auxiliary stationary contact member and extends from the base terminal 16 in the direction of the open position of the contact member 30. The arc, drawn by the opening of member 30 impinges on the chute and the evolving gas blows the arc away from the contact. In FIG. 1 the assembly 34 schematically represents the arc chute assembly, the auxiliary stationary contact member, and the novel arc supporting means arranged within the arc chute.

Figure 3:
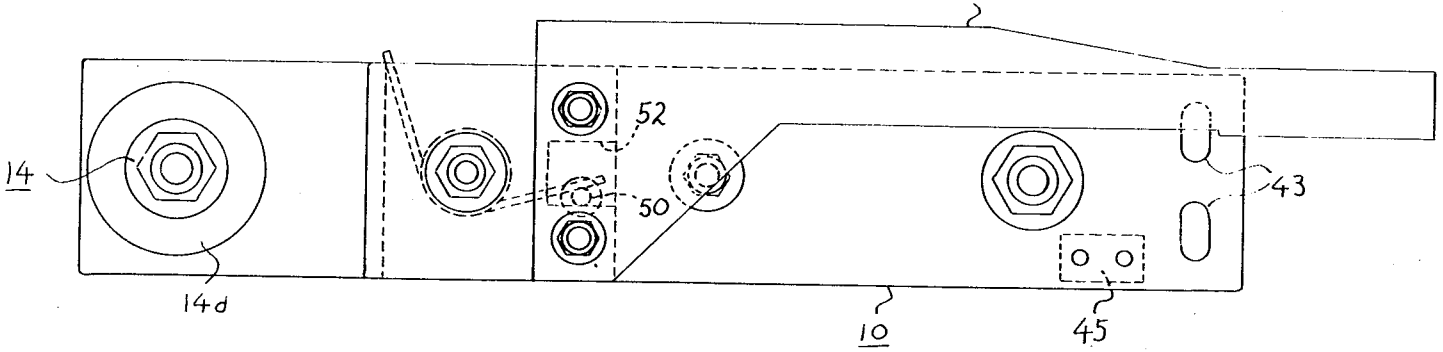
FIG. 3 is a front elevation view of the contact members illustrated in FIG. 2.

The above described components are now described in more detail. The moveable contact members 10 and 30 of the preferred embodiment which utilize features known in the art, are shown in FIGS. 2 and 3. The main moveable contact member 10 comprises parallel blades 10*a* and 10*b* secured to one another with appropriate separation by previously referenced pin members 14 and 28, and by member 40. Each of these comprise a bolt having its head on the outer surface of one blade member and secured by a nut on the outer surface of the other blade member. The bolts support a bushing or spacer (14*a*, 28*a* and 40*a*, respectively) intermediate the blade members. One end of member 10 is pivotably mounted to base terminal 12 by bushing 14*a*. Silver rings 14*c* located at the interface of blades 10*a* and 10*b* and bushing 14*a* provide for current transfer from base terminal 12 to member 10. These rings may be formed by coining the rings as indicated by line 14*d* of FIG. 3. The hinge pressure of member 10 can be set by adjustment of the take up nut on the bolt of member 14. For this purpose a coiled compression spring 14*b* is secured intermediate washers between blade 10*a* and the take up nut of member 14. The operating rod is pivotally mounted to member 10 by bushing 28*a*. The opposing end of blades 10*a* and 10*b* have indented portions providing contact terminals 43 whose heavily silvered surface is adapted to engage the main stationary member 18, shown in FIG. 1. Member 40 has a compression spring arrangement, including spring 40*b*, like that of member 14, for adjustment of contact pressure between members 10 and 18. Referring to FIG. 3, switch closure results in clockwise motion of member 10 and downward movement of the end bearing the contact terminals 43. Special arcing contacts 45 of suitable material, such as copper tungsten, are preferably provided at the blade portions that initially touch stationary contact member 18.

The auxiliary moveable contact assembly 30 comprises the flipper arm 42 and flipper support 46. Flipper arm 42 is fastened by bolts 44 to one arm of U-shaped flipper support 46. Support 46 is pivotally connected to blade 10*a*, by bolt 32 which extends through blade 10*a* and the two arms of the support. For this purpose washers are interposed, respectively, between blade 10*a* and the adjacent arm of support 46 and between the other arm of the support and the retaining nut. The arm of support 46 adjacent to blade 10*a* has a rectangular notch 52 adjacent to its outer edge. Stop pin 50 is secured to blades 10*b* and 10*a* and extends orthogonally outward from blade 10*a* into notch 52. When the switch is closed and blades 10*a* and 10*b* pivot clockwise pin 50 abuts against the lower edge of notch 52. Accordingly neither support 46 nor flipper blade 42 pivot in respect to blades 10*a* and 10*b*. The flipper blade thus pivots in parallel with the main blades 10*a* and 10*b* during switch closure. Because of the configuration of the flipper and main blades, the latter contact the main stationary contact 18 before the flipper blade makes contact with the auxiliary stationary contact member.

During opening of the switch, blades 10*a* and 10*b* pivot counterclockwise to break contact with the main stationary contact 18. As described subsequently the flipper arm 42 is restrained from moving until the main contact members 10 and 18 have broken contact. Thus there is relative rotation between main member 10 and auxiliary moveable member 30, i.e. flipper 42 and support 46. This is enabled by motion of pin 50 within notch 52. However subsequent to a predetermined small rotation of main member 10 in respect to auxiliary member 30, pin 50 strikes and engages the upper wall of notch 52. As the main member 10 continues its counterclockwise rotation, the auxiliary moveable member 30 is thus forced to move counterclockwise and break its contact with the auxiliary stationary member.

A torque spring 54 is coiled on a bushing secured by bolt 32 between the two arms of support 46. One end 56 of the spring engages the bight of the U-shaped support 46 and the other end, 58, of the spring engages stop pin 50. When the switch is opened, main moveable contact member 10 initially pivots counterclockwise in respect to auxiliary moveable contact member 30. The resulting upward motion of pin 50 in notch 52 charges spring 54. When the pin 50 engages the top wall of notch 52 and releases flipper arm 42, the torque spring forces support 46, and thus flipper 42, to rapidly move counterclockwise in respect to stop pin 50 and member 10. This results in the flipper arm 42 snapping upward in a counterclockwise pivotal motion until pin 50 reengages the lower edge of notch 52. This snap action provides for rapid extinction of the arc generated when the auxiliary contact members break contact.

Figure 7:
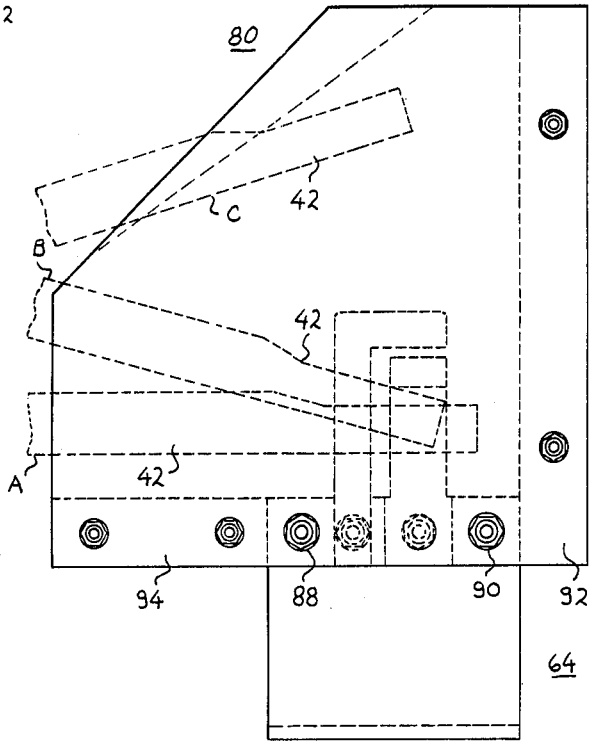
FIG. 7 is a front elevation view of the assembly illustrated in FIG. 6, and a schematic representation of the auxiliary moveable member in latched and unlatched positions.
Figure 4:
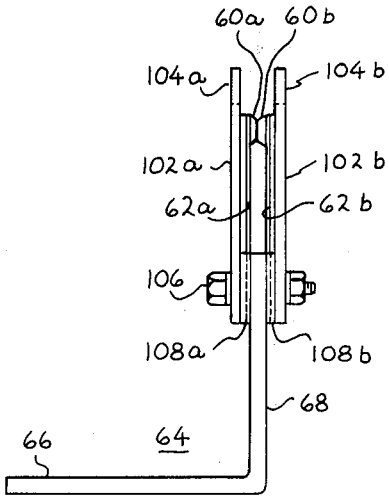
FIG. 4 is a side elevation view of the auxiliary stationary member and arc supporting means of the preferred embodiment of the invention.
Figure 5:
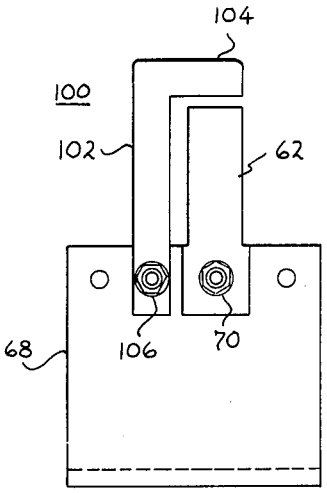
FIG. 5 is a front elevation view of the auxiliary stationary member and arc supporting means illustrated in FIG. 4.

Reference is now made to FIGS. 4 and 5. The auxiliary stationary contact member comprises abutting contact members 60*a* and 60*b* each secured by a planar support member 62*a* and 62*b* respectively, to a support bracket 64 which is adapted to be secured to base terminal 16 (which is shown in FIG. 1). Thus electrical contact is established between the base terminal and the contact members 60*a* and 60*b*. The support bracket is a right angle bracket having a horizontal plate portion 66, adapted to be fastened to the base terminal and a vertical plate portion 68. The rectangular planar support members are fastened, adjacent to one of their longitudinal ends, to opposing sides of plate portion 68 by bolt 70. The rectangular contact members 60*a* and 60*b* are secured to the inward, i.e. adjacent, faces of the support members at, or near, their other longitudinal ends. The contact members 60*a* and 60*b* are of substantially identical thickness such that they abut one another. The planar supports 62*a* and 62*b* are spring members adapted to maintain the pair of contact members in abutting relation but to permit their lateral separation to permit entry and exit of the flipper arm. Supports 62*a* and 62*b* may, for example, comprise a lamination of steel and phosphor bronze. The above described assembly is mounted such that the stationary contact members and the planar supports are arranged so that plate portion 68 extends in the plane of motion of the flipper blade 42 and the stationary contact members are arranged on opposite sides of this plane. When the switch is closed the flipper blade decends with sufficient force to stab through the normally abutting contact members 60*a* and 60*b* until it attains a latched, i.e. engaged, position intermediate supports 62*a* and 62*b*, contact members 60*a* and 60*b* and support bracket portion 68. This latched position of the flipper blade is illustrated by "A" in FIG. 7. When the switch is opened, and main moveable contact member 10 pivots counterclockwise, the flipper blade initially pivots until it is temporarily restrained by contact members 60*a* and 60*b*. This position, assumed by the flipper arm just prior to unlatching, is illustrated by "B" in FIG. 7. In this position the auxiliary contact members make contact while the main contacts break contact. Finally, as previously described, the flipper blade stabs through the abutting contact members 60*a* and 60*b* and rapidly flips toward the open, i.e. unlatched position. "C" of FIG. 7 illustrates the flipper blade in a position intermediate the latched and open positions. In order to facilitate the described stabbing action, the abutting edges of the pair of contact members 60*a* and 60*b* are canted. The contour of these canted surfaces is selected to assure that the flipper arm will reliably and repetitively stab through contact members 60*a* and 60*b*.

Figure 6:
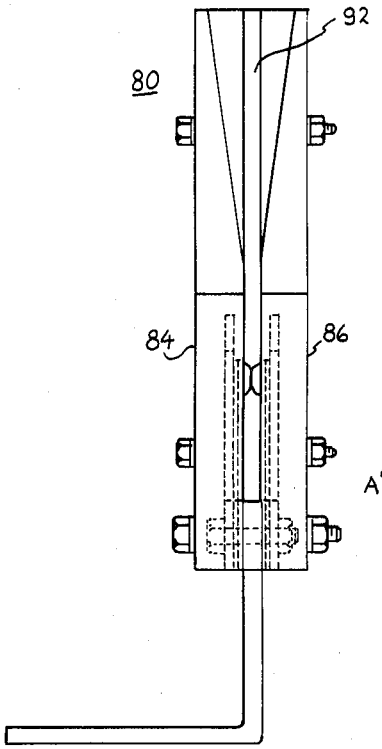
FIG. 6 is a side elevation view of an assembly of the arc chute and of the components illustrated in FIGS. 4 and 5.

As illustrated by FIGS. 6 and 7 an arc chute 80 extends upward from the support bracket 64 toward the open position of the flipper blade 42. The arc chute of the preferred embodiment comprises two plates, 84 and 86, extending in parallel on opposing sides of the plane of pivotal motion of the flipper blade. The plates are bolted to the opposing sides of portion 68 of the support bracket by bolts 88 and 90. They are thus separated sufficiently to provide for unrestricted passage of the flipper blade. The plates 84 and 86 are made of ablative and gas evolving substance such as an acrylic material. The arc chute is closed at the rear by spacer member 92 and at the bottom by spacer member 94. An arc is generated when the auxiliary contact members open. The gases evolved from the plastic arc chute blow the arc away from the moving flipper blade. The arc is drawn out and extinguished as the flipper blade snaps away from stationary contact members 60*a* and 60*b*.

Arc supporting means 100 is located within the arc chute 80 adjacent the path taken by the auxiliary moveable member, i.e. flipper blade, as it opens so as to be intermediate the position where it engages the auxiliary stationary contact members 60*a* and 60*b* and its open position. The means 100 is displaced from the open position of the flipper blade by a sufficient distance to assure that an arc will be properly extinguished. The arc supporting means is thus positioned close to the auxiliary stationary contact means, i.e. the pair of contacts 60*a* and 60*b*. This is desirable since it provides for rapid arc transfer from contacts 60*a* and 60*b* to means 100 as the flipper blade is unlatched and commences to flip to the open position. Arc transfer results as soon as the distance from the auxiliary moveable contact means, i.e. the flipper blade, to the arc support means 100 becomes less than the distance from the flipper blade to the auxiliary stationary contact means, i.e. contacts 60*a* and 60*b*. However, the separation between the arc transfer means and the auxiliary stationary contact means should be sufficient to prevent the arc from jumping back from means 100 to contact members 60*a* and 60*b*. The arc supporting means 100 must also be separated sufficiently from the path of motion of the flipper blade to provide for unobstructed movement of the latter. With repeated switch cycling means 100 will become pitted. Accordingly the above referenced separations should be sufficient even when the arc supporting means acquires some deformation of the surface to which the arc adheres.

The arc supporting means of the preferred embodiment utilizes an L-shaped member comprising a first leg 102 and a second leg 104 extending orthogonally in respect to the first leg. The L-shaped member 100 is fastened to portion 68 of support bracket 64. This provides a low impedance circuit between contact members 60*a* and 60*b* and the arc supporting means so that these components are maintained at substantially the same potential. This enhances arc transfer. The L-shaped arc supporting means is fastened to the support bracket near the end of leg 102, that is remote from leg 104, by bolt 106. Leg 102 extends adjacent to and parallel to planar support 62 such that leg 102 is preferably displaced from support 62 toward the open position of the flipper blade. Leg 104 extends adjacent, and parallel, to contact member 60 such that it is displaced from the latter along the path of the opening flipper blade. This relationship is shown in FIG. 7. A small gap distance is maintained between contact member 60 and leg 104, and between planar support 62, as well as leg 104, and leg 102. The L-shaped member is also displaced from the plane of pivotal motion of the flipper blade by a distance slightly greater than the distance from that plane to planar member 62. This spacing is attained by interposing a shim 108 intermediate plate portion 68 and leg 102. Accordingly adequate clearance is provided for unobstructed motion of the flipper blade and for unobstructed lateral motion of planar spring members 62*a* and 62*b*. The preferred embodiment utilizes one L-shaped member on each side of the plane of pivotal motion of the flipper blade. The arc supporting assembly members 102*a* and 104*a* are located on one side of plate portion 68 and are spaced therefrom by shim 108*a*. Arc supporting members 102*b* and 104*b* are located on the opposite side of plate portion 68 and are spaced therefrom by shim 108*b*. Components 102*a*, 102*b* and 108*a*, 108*b* are secured to plate portion 68 by bolt 106. This arrangement is particularly desirable since it provides arc supporting means adjacent to each of contact members 60*a* and 60*b*. It is also believed to be desirable because the L-shaped arc supporting means is adjacent to both the top and side edges surfaces of the contact member that are adjacent to the path of the flipper blade as it opens.

However, various alternatives may be utilized. For example, only one arc supporting member may be utilized instead of two. Such a single member could be located on either side of plate portion 68.

Various alternative forms of arc supporting means may be utilized which provide advantageous features of the inventive concept. Two of these are illustrated in FIGS. 8 and 9. In the arrangement of FIG. 8 the planar spring members 262*a* and 262*b* are secured by bolt 270 to opposing sides of the plate portion 268 of a support bracket. The pair of normally abutting contact members 260*a* and 260*b* are secured on the inboard sides of members 262*a* and 262*b* in the manner illustrated in FIG. 4. However planar members 262*a* and 262*b* extend longitudinally beyond the contact members. Arc support members 204*a* and 204*b* are secured to the inboard sides and near the longitudinal ends of members 262*a* and 262*b*. The arc supporting members thus extend inwardly toward the plane of motion of the flipper blade. However the width of arc supporting members 204*a* and 204*b* is sufficiently less than the width of contact members 260*a* and 260*b* to assure clearance between the adjacent faces of members 204*a* and 204*b*. This provides for the required unobstructed passage of the flipper blade.

The arrangement of FIG. 9 utilizes conductive support members 302*a* and 302*b* for arc supporting members 304*a* and 304*b*. The support members 302*a* and 302*b* are arranged on opposing sides of the planar spring members 362*a* and 362*b* that bear the contact members. Support members 302 and planar spring members 362 can be secured to plate portion 368 of the support bracket by a single bolt 370. The planar spring members are secured intermediate the conductive support members. These members are sufficiently displaced from each other by shim members 308*a* and 308*b* to provide for unobstructed lateral motion of the planar spring members. Because of the resulting displacement of members 302 from the plane of motion of the flipper blade it is desirable for arc supporting members 304*a* and 304*b* to have a greater width than the width of the arc supporting members 204*a* and 204*b* utilized in the arrangement of FIG. 8.

The arc supporting means in all of the described embodiments constitute a consumable arcing contact made of a conductive material preferably having a high melting point temperature, e.g. steel, copper or brass. The arc support means are preferably connected in a low impedance circuit so as to maintain them at the same potential as the stationary contact members.

It should be noted that the invention is not limited to the specific type of load break switch assembly described herein. Although this invention has been described with reference to specific embodiments thereof, numerous modifications are possible without departing from the invention, and it is desirable to cover all modifications falling within the spirit and scope of this invention.

What I claim as new and desire to secure by Letters Patent of the United States is:

1. In a load breaker switch of the type comprising main contact members adapted to be disengaged from one another, auxiliary stationary contact means and auxiliary moveable contact means adapted to engage one another and to make contact while the main contact members disengage and to thereafter break contact by rapid movement of the auxiliary stationary member along a predetermined path to an open position, the combination comprising:

(a) means to prevent disengagement and movement of said auxiliary moveable contact means until after disengagement of said main contact members;

(b) arc supporting means secured adjacent to, and connected in a low impedance electrical circuit with said auxiliary stationary contact means;

(c) said arc supporting means being disposed adjacent to the path of movement of said auxiliary moveable member at a position of the path intermediate said auxiliary stationary member and said open position to provide for transfer of arc attachment from said auxiliary stationary member upon disengagement of said auxiliary members so as to reduce physical deterioration of said auxiliary stationary member.

2. The arrangement of claim 1 wherein said auxiliary moveable contact means is adapted for pivotal motion, said auxiliary stationary contact means comprises a pair of stationary contact members positioned to abut each other from opposing sides of the plane of pivotal motion, said last named members being spring biased for displacement orthogonal to said plane to permit entry and exit of said auxiliary moveable contact means, and said arc supporting means comprising at least one conductive member orthogonally displaced from the plane of pivotal motion.

3. The arrangement of claim 2 wherein said stationary contact members extend from planar spring members fastened to a conductive support member so as to be arranged on opposing sides of said plane of pivotal motion and said arc supporting means are connected in a low impedance electrical circuit to said conductive support member.

4. The arrangement of claim 3 comprising arc chute means arranged about said planar spring members and said pair of stationary contact members and providing an opening for said plane of pivotal motion to provide for unobstructed motion of said auxiliary moveable contact member.

5. The arrangement of claim 4 wherein said arc support means are secured to at least one of said planar spring members at a position longitudinally displaced from said contact members.

6. The arrangement of claim 4 wherein said arc supporting means comprise a leg support member secured to said conductive support member.

7. The arrangement of claim 6 wherein said arc supporting means comprise a member extending orthogonal to said leg support member and parallel to said plane of pivotal motion.

8. The arrangement of any of claims 2–7 comprising at least one arc supporting means on each side of the plane of pivotal motion.

9. A load breaker switch, comprising:

(a) a main contact member;

(b) a longitudinal blade assembly pivotally mounted for engagement with said main contact member;

(c) a longitudinal flipper blade assembly pivotally mounted to said longitudinal blade assembly;

(d) a pair of stationary contact members arranged about the plane of pivotal motion of said flipper blade and spring biased to engage one another;

(e) said flipper blade being adapted to stab into said pair of stationary contact members subsequent to pivotal closure of said blade assembly and its engagement with said main contact member and to disengage from said pair of stationary contact members subsequent to disengagement of said blade assembly from said main contact member;

(f) at least one arc supporting means displaced from the plane of pivotal motion of said flipper blade assembly and sufficiently displaced from said stationary contact members in the direction of the path of opening of said flipper blade assembly to provide for a point of arc attachment upon disengagement of said flipper blade assembly from said pair of contact members to reduce physical deterioration of the latter; and (g) an arc chute assembly arranged about the plane of pivotal motion of said flipper blade assembly, said pair of stationary contact members, and said arc supporting means.

10. The load breaker switch of claim 9 wherein said pair of stationary contact members is secured to planar spring members extending longitudinally in the direction of displacement of said flipper blade assembly from a conducting base member, said spring members extending on opposing sides of the plane of pivotal motion of said flipper blade, and said arc supporting means being connected to said conducting base member in a low impedance electrical circuit.

11. The arrangement of claim 10 wherein said arc supporting means are supported by a first leg member extending longitudinally from said conducting base member so as to be parallel to said plane of pivotal motion.

12. The arrangement of claim 10 wherein said arc supporting means are secured to at least one of said planar spring members so as to be displaced from said stationary contact members in the direction of the path of opening of said flipper blade assembly.

13. The arrangement of claim 11 wherein said arc supporting means comprise a second leg member extending orthogonally from said first leg member and are displaced from said stationary contact member in the direction of the path of opening of said flipper blade assembly.

14. The arrangement of claim 11 wherein said first leg member is orthogonally displaced in respect to said plane of pivotal motion beyond said planar spring member.

15. The arrangement of claim 11 wherein said arc supporting means extend orthogonally from said first leg member toward said plane of pivotal motion.

16. The arrangement of any of claims 9–5 comprising an arc supporting member arranged on each side of the plane of pivotal motion.

* * * * *

UNITED STATES PATENT AND TRADEMARK OFFICE

CERTIFICATE OF CORRECTION

PATENT NO. : 4,289,941

DATED : September 15, 1981

INVENTOR(S) : John W. Cannon

It is certified that error appears in the above—identified patent and that said Letters Patent is hereby corrected as shown below:

Column 8, line 66, delete "stationary member" and insert --moveable contact means--

Column 10, line 56, change "5" to --15--

Signed and Sealed this

*Third* Day of *November 1981*

[SEAL]

*Attest:*

GERALD J. MOSSINGHOFF

*Attesting Officer*

*Commissioner of Patents and Trademarks*